US006678922B2

(12) United States Patent
Comer et al.

(10) Patent No.: US 6,678,922 B2
(45) Date of Patent: Jan. 20, 2004

(54) BAG CLOSURE OR CLAMP MADE FROM PLIABLE, RESILIENT HOSE

(76) Inventors: Alan Elbert Comer, P.O. Box 1134, Olalla, WA (US) 98359; William Albert Bladen, Jr., 10680 Cub Ct., Grass Valley, CA (US) 95949

( * ) Notice: Subject to any disclaimer, the term of this patent is extended or adjusted under 35 U.S.C. 154(b) by 0 days.

(21) Appl. No.: 10/190,173

(22) Filed: Jul. 6, 2002

(65) Prior Publication Data

US 2003/0005555 A1 Jan. 9, 2003

Related U.S. Application Data

(60) Provisional application No. 60/303,510, filed on Jul. 6, 2001.

(51) Int. Cl.[7] ..... B65D 33/00; B65D 77/00

(52) U.S. Cl. ..... 24/30.5 R; 24/30.5 P; 24/543; 24/555; 24/559; 383/13; 383/75

(58) Field of Search ..... 24/30.5 R, 30.5 P, 24/555, 561, 563, 559, 520, 462, 464, 543, 30.5 S; 383/13, 75; 198/699

(56) References Cited

U.S. PATENT DOCUMENTS

| | | | | | |
|---|---|---|---|---|---|
| 1,362,651 | A | | 12/1920 | Towns | |
| 3,141,221 | A | | 7/1964 | Faulls, Jr. | |
| 3,266,711 | A | | 8/1966 | Song | |
| 4,296,529 | A | | 10/1981 | Brown | 24/30.5 P |
| 4,834,730 | A | * | 5/1989 | Holtermann et al. | 24/543 |
| D301,548 | S | * | 6/1989 | Weaver | 24/30.5 R |
| 5,379,489 | A | | 1/1995 | Delk et al. | 24/30.5 R |
| 5,664,296 | A | * | 9/1997 | May | 24/30.5 R |
| 5,682,649 | A | | 11/1997 | Lo | 24/30.5 R |
| 5,713,108 | A | | 2/1998 | Solomon et al. | 24/30.5 R |
| 5,983,460 | A | | 11/1999 | Hyde et al. | 24/30.5 R |
| 6,298,526 | B1 | * | 10/2001 | Baumdicker et al. | 24/559 |

* cited by examiner

*Primary Examiner*—Victor Sakran

(57) ABSTRACT

Bag closure 100, formed from a single length of pliable, resilient substantially-tubular hose comprises a first "base" section 10 of unmodified hose, a second narrowed "neck" section 20, and a third "clamp" section 30. Clamp section 30 is a trimmed section of hose having a substantially C-shaped cross section, formed by removing a narrow strip of hose material parallel to the hose axis. Hinge 20 is a trimmed section of hose having a substantially parenthesis-shaped cross section, formed by removing a wider strip of hose material parallel to the hose axis. A bag neck may be sealed by laying the flattened bag neck across substantially-cylindrical base 10, folding the closure at its narrowed neck or hinge 20 and forcing clamp section 30 over base 10, trapping the bag neck between base 10 and clamp 30 and forming a tight seal.

17 Claims, 5 Drawing Sheets

BAG CLOSURE OR CLAMP MADE FROM PLIABLE, RESILIENT HOSE

CROSS-REFERENCE TO RELATED APPLICATIONS

This application claims the benefit of Provisional Patent Application Ser. No. 60/303,510 filed Jul. 6, 2001.

FEDERALLY SPONSORED RESEARCH

Not Applicable

SEQUENCE LISTING OR PROGRAM

Not Applicable

BACKGROUND

1. Field of Invention

This invention relates to bag closures, specifically reusable closures which are used for closing the necks of plastic bags, and especially to bag closures of the type generally comprising two separate but complementary elongated members which trap the flattened neck of said bag between them when mated.

2. Description of Prior Art

Bags formed of polyethylene or other plastics are commonly supplied to grocery shoppers for holding produce. Similar bags are available for separate purchase, and are useful in storing groceries and other materials; and various consumer goods are packaged in such bags.

Bags containing pre-packaged goods are often heat-sealed or closed in some other permanent manner when the consumer receives them. However, if the entire pre-packaged contents are not removed from the bag at its first opening, then the consumer must reseal the bag between openings. If repeated access to the bag contents is desired, a reusable bag closure is required.

Various solutions to this dilemma have been produced over the years, in many forms. For example, twist ties with a wire core, which are twisted around a gathered bag neck, are one of the oldest and lowest-cost solutions. However, such wire ties require a substantial "twisting" motion to apply, and must be tightly wound in order to form a tight closure; in fact, it is difficult to make a water-tight seal with a wire tie. And wire ties quickly become damaged and unsightly with use, unlike a true reusable bag closure. Even new, a wire tie is rather unsightly, and can sometimes have a protruding wire end that can poke the user or the bag.

Other low cost bag closures have been produced, including an assortment of related small, flat closures, generally made of frangible plastic, which trap a gathered bag's neck within a notch or otherwise confine the neck of the bag in a bunched or gathered state. However, this type of closure can be reused only a few times, since it is generally bent or twisted when removed. Also, these closures are easily lost or misplaced. And since the bag neck is gathered when closed, it is difficult to form a reliable "water-tight" seal with this type of closure, as well.

There is another class of bag closures with superior performance, which clamp a bag neck over the entire bag width when it has been smoothed and flattened, making a more positive seal possible. Of course, such closures are larger and more expensive to produce than the "throw-away" closures discussed previously. But bag closures in this category are also generally more durable, suitable for indefinite use, so a somewhat greater cost is acceptable. And the appearance of this type of bag closure is generally neater and more appealing. Consumers are willing to pay a somewhat greater price for a superior bag closure which provides a better seal and a neater appearance, and which can be used indefinitely.

Various mechanisms can be used in such closures for clamping the flattened back neck; in fact, the concept of trapping flattened thin fabrics or other flexible sheet materials between two linear members has been used for a long time. For example, U.S. Pat. No. 1,362,651 to Towns in 1920 described a method of trapping a flat section of canvas material between a tubular rib and a spring metal "case" having a substantially C-shaped cross-section with an inner radius approximately equal to the outer radius of the rib. Although Towns intended his invention for use primarily in farm machinery, many bag closures have been designed which use essentially this same mechanism.

For example, U.S. Pat. No. 3,141,221 to Faulls describes a closure for flexible bags comprising two separate but complementary elongated rigid members which trap a flattened bag neck between them when mated. This design closely resembles Towns' canvas trapping mechanism, and provides a durable, truly reusable bag closure. But this type of bag closure is relatively expensive to produce, requiring the separate manufacture of two large parts. And making the closure a two-part assembly also requires the user to keep track of both sections between uses; if one section is lost, the entire expensive assembly is useless.

U.S. Pat. No. 3,266,711 to Song describes a similar closure with two separate members; however, Song goes on to describe an improved version of the closure, wherein the two primary members are joined together by a link or hinge formed from the same plastic or other material which forms the two complementary members. However, Song's bag closures still require a manufacturing process wherein each bag closure is created separately (albeit in a single operation for the hinged version) by molding the material which forms the closure. And Song explicitly teaches that the interior diameter of the female member must always exceed the exterior diameter of the male member, which creates an implicit limit on the materials which may be used to form a closure according to Song.

More recently, other designs have been made which connect the two sections of such a bag closure. For example, U.S. Pat. No. 4,296,529 to Brown shows a one-piece hinged bag sealing device comprising paired linear strips which trap the flattened bag neck when the hinge closes, and further comprising a locking clasp at the far ends to lock the hinge closed. Further, U.S. Pat. No. 5,379,489 to Delk et al. shows a similar hinged assembly wherein the trough-like shape of one member fits over the bladelike opposing member, trapping the bag neck, again with a separate locking mechanism. And U.S. Pat. No. 5,713,108 to Solomon et al. shows a bag closure comprising a pair of rigid linear members called the locking arm and the receiving arm, also joined at a hinge and having elongated seating shoulders for interlocking engagement, obviating the need for a separate locking clasp. These designs do advantageously eliminate the need for multiple separate pieces, so that a user is not required to keep track of them. Solomon's design even eliminates the need for a separate locking mechanism. However, all are still relatively expensive to produce, since they require the separate manufacture of several components which must then be assembled. And these closures' common rigid, elongated hinged design is inherently weak, having a tendency to break at the hinge if inadvertently stressed in the opened state. This problem leads to premature failures if these closures are made from commonly-available low cost materials; or alternatively, if they are made from stronger metals, it leads to even greater cost.

U.S. Pat. No. 5,664,296 to May shows a bag with a built-in closure where the two separate complementary members, again circular and C-shaped in cross sections, respectively, are mounted directly to opposing inside faces of the bag. The concept embodied in this invention is revolutionary and has led to the tremendously popular "zipper" type of plastic bags which are quite common today. This approach combines the bag and the bag closure into one, and essentially creates a new product, the "zipper bag", which competes directly with simpler bags without built-in closures. For some types and sizes of bags, the zipper bag has since become dominant. However, the zipper bag has not and will not become universal, because of the following limiting factors: 1) The zipped closure does not form a strong enough seal for some uses; 2) the zipper closure manufacturing process is not always compatible with the bag manufacturing process; 3) the zipper closure must be produced for an extremely low cost, comparable or less than the cost of producing the bag, in order to be practical; and 4) even with such a low manufacturing cost, a zipper bag is still costlier to produce than a similar bag without such a closure.

Thus, although the new zipper bag type is extremely popular, these factors dictate that plastic bags without such built-in closures will still be used for the foreseeable future. For example, it appears that adding zipper type closures is impractical or adds substantially to the price of bags made out of certain less flexible "crackly" types of plastics, which are much favored by manufacturers for their ability to carry colorful advertising and labeling, zipper closures are rarely seen on this type of bag. And some types of plastic bags are just not practical to produce with zipper closures. For example, the produce bags most common in stores today are made of strong but extremely thin plastics. These bags are much thinner than the plastics generally used to produce a zipper closure. Even if it were feasible to connect such a bag to a zipper closure, there would likely be more plastic in the zipper than in the whole bag, making such an amalgam not cost-effective. And zipper closures have a typical strength which may not be great enough for larger or heavier contents, many manufacturers continue to package their products using heat-sealed bags, since the heat-sealed closure is typically similar in strength to the bag itself. Finally, when using the bag for storing foodstuffs, keeping the "zipper" clean and sanitary, as it must be since it is mounted inside the bag opening, becomes a problem for repeated use.

OBJECTS AND ADVANTAGES

Accordingly, several objects and advantages of the present invention are:

1. To provide a bag closure which traps a flattened bag neck, providing a tight seal.
2. To provide a durable bag closure which can be reused indefinitely.
3. To provide a bag closure with a simple one-piece hinged construction.
4. To provide a hinged bag closure wherein the hinge is not subject to breakage if stressed when opened.
5. To provide a simple hinged bag closure which can be manufactured for lower cost than other hinged bag closures.
6. To provide a simple hinged bag closure which can be manufactured more quickly and easily than other hinged bag closures.
7. To provide a simple hinged bag closure which may be easily cleaned.
8. To provide a simple hinged bag closure which provides means for orderly storage of bagged materials.

SUMMARY

A novel bag closure 100, advantageously formed from a single length of low-cost pliable yet resilient substantially-tubular hose comprises a first "base" section 10 of unmodified hose, a second narrowed "neck" section 20 near the center of the closure, and a third "clamp" section 30. Clamp section 30 may be formed by removing a narrow linear strip of hose material along a line substantially parallel with the cylindrical axis of the hose, thus leaving a section of hose with a substantially C-shaped cross section; the width of the removed strip is generally less than half of the circumference of hose section 30, so that section 30 will clamp over base 10. Hinge 20 is formed similarly, except that the removed strip represents a greater proportion of the hose material; in general, more than half of the hose material will typically be removed in neck 20, leaving only a narrow strip of material with a substantially parenthesis-shaped cross section joining sections 10 and 30. A bag neck may be sealed by laying the flattened bag neck across cylindrical base 10, folding the closure at its narrowed neck or hinge 20 and forcing clamp section 30 over the cylindrical base 10, trapping the bag neck between base 10 and clamp 30 and thus forming a tight seal.

Various topological variations of the basic tubular hose are discussed, offering potential ways to make the seal tighter, or ways to offset potential material limitations of the hose itself.

Finally, a manufacturing method is described that promises considerable savings in manufacturing costs, by making hinge 20 and clamp 30 complementary such that closure 100 and a second closure 200 can be cut from a single piece of hose, with little wasted hose material.

DRAWINGS

Drawing Figures

Figure 3A:
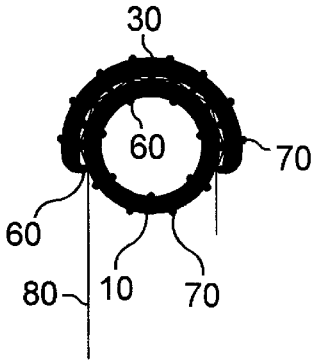

FIGS. 3*a,b,c* are cross-sectional views of optional topological variants of the basically cylindrical geometry of the present invention.

Figure 4:
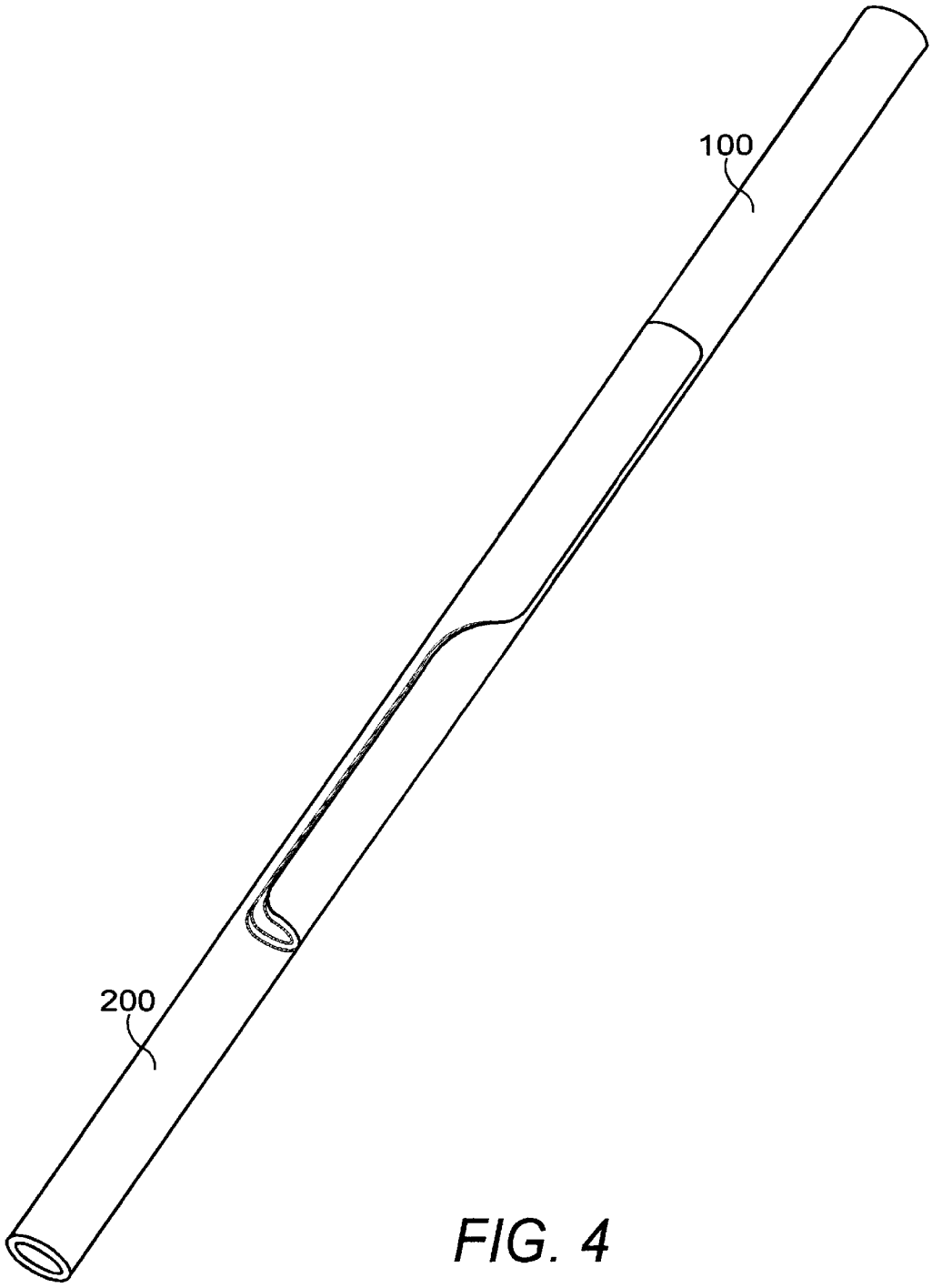

FIG. 4 is a diagram showing how bag closures of the present invention might be fabricated with little or no wasted material.

Figure 5:
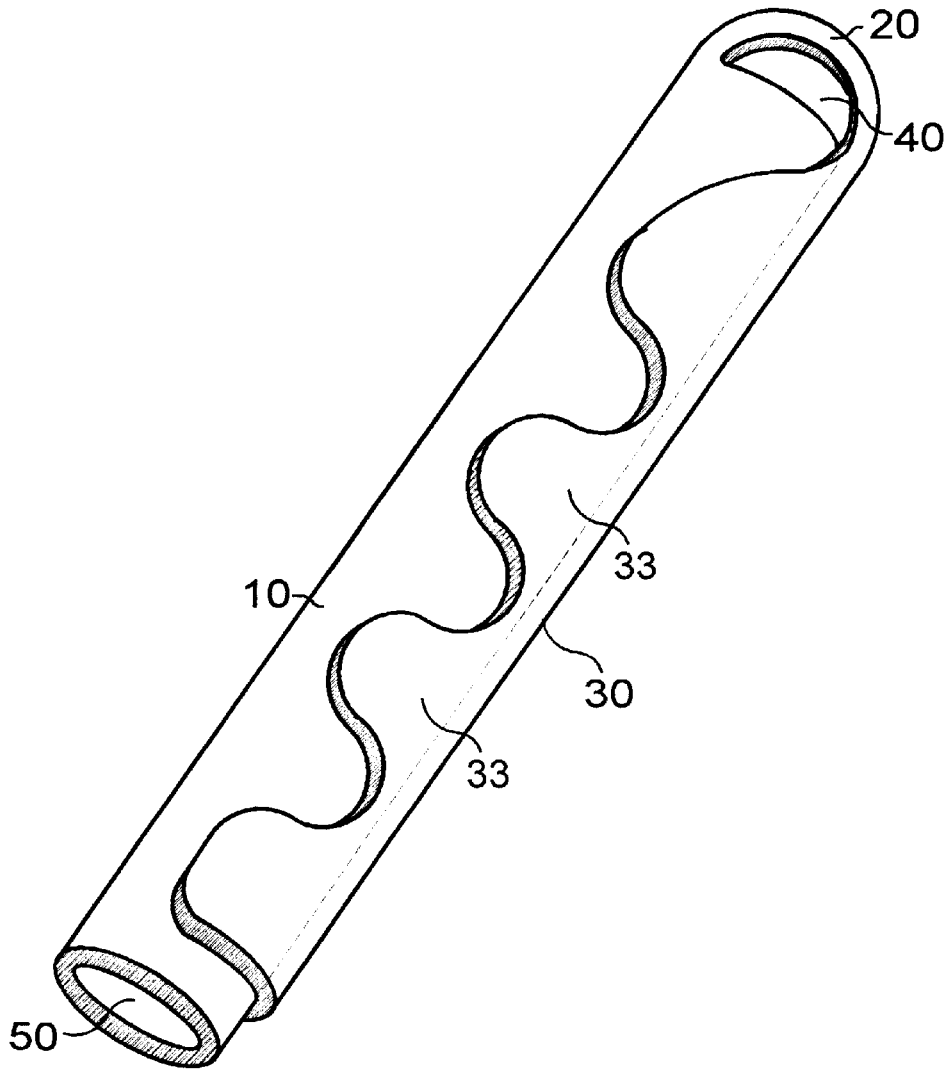

FIG. 5 is a diagram showing how clamp section 30 might be formed with a non-uniform cross-section, forming fingers 33 which aid in forming a tight seal across a bag neck.

REFERENCE NUMERALS IN DRAWINGS

10 Section of unmodified hose forming base of bag closure 100

15 "Shoulder" of base 10 where base 10 merges into neck 20

20 "Neck" section of hose with narrow "parenthesis-shaped" cross section, forming the "hinge" portion of bag closure 100

25 "Shoulder" of clamp 30 where clamp 30 merges into neck 20

30 Section of hose with C-shaped cross-section forming the "clamp" portion of bag closure 100

33 Fingers which may be formed in section 30 if its substantially C-shaped cross-section is allowed to vary

35 Cut end or opposite "shoulder" of clamp section 30

40 Loop formed by hinge 20 when bag closure 100 is in the folded position

50 Axial hole in cylindrical hose section 10 of closure 100

60 Inner hose ridge

70 Outer hose ridge

80 Plastic bag

100,200 Bag closures of the present invention

DETAILED DESCRIPTION

The bag closure of the present invention uses the familiar, time-honored method of tightly trapping a layer of thin material between a substantially cylindrical tube and a C-shaped clamp, in order to form a reliable, tight-fitting seal. However, the present invention differs from the prior art in forming both tube and clamp not from substantially rigid materials but from low-cost pliable, resilient hose. Advantageously, both tube and clamp are both formed from a single length of hose; they are joined by a thin strip of flexible material, also formed from the same length of hose, which both keeps the two sections together, and acts as a hinge between them. Constructing the bag closure in this manner makes it not only simpler and more foolproof than previous designs, but also lower in cost, easier and quicker to manufacture, more durable and less susceptible to breakage than prior art hinged bag closures.

Figure 1:
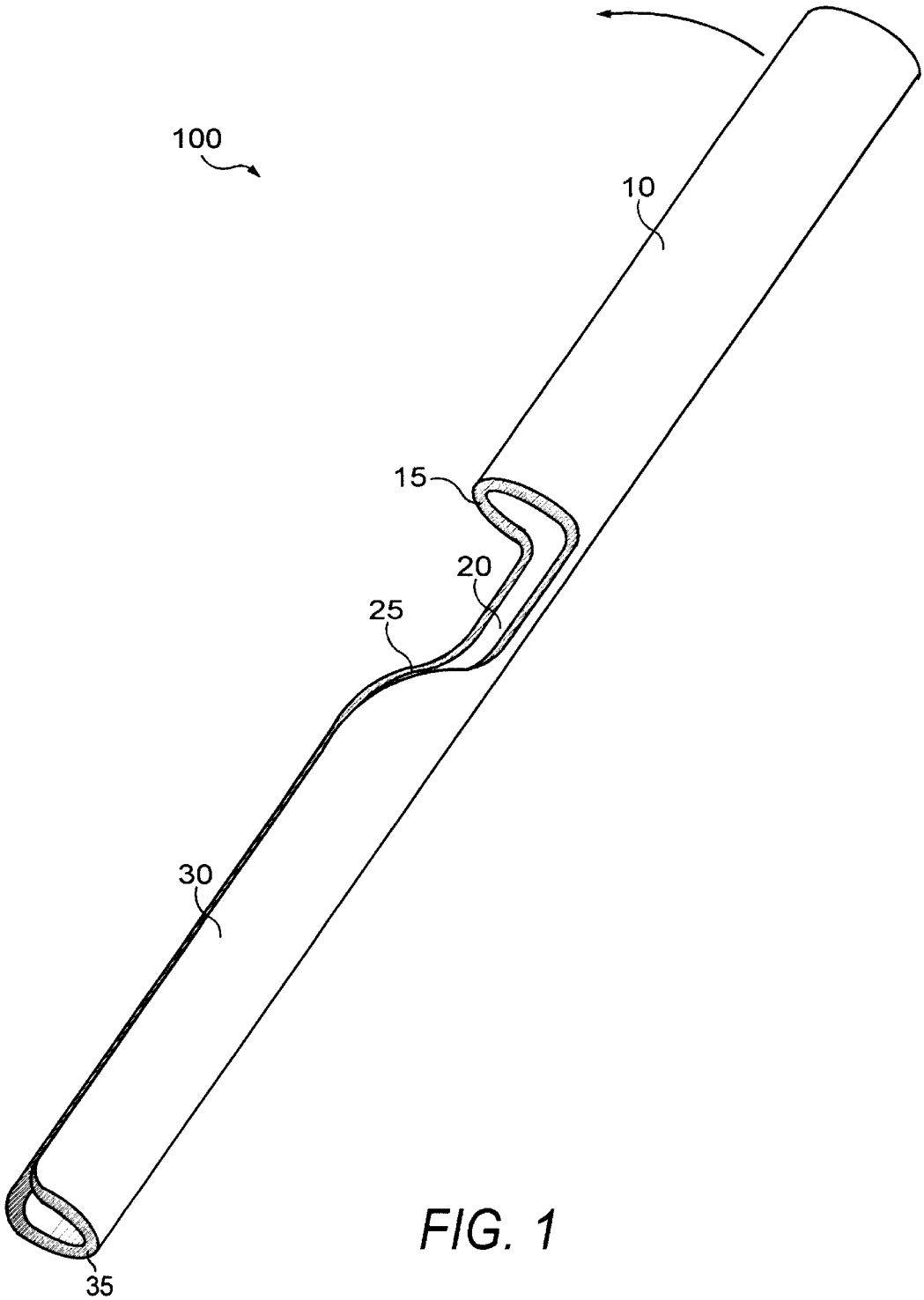
FIG. 1 is a diagram showing the bag closure of the present invention in its extended, unfolded state.

Description-FIG. 1—Bag Closure 100

FIG. 1 shows bag closure 100 of the present invention, in its extended, unfolded state. The bag closure may be advantageously formed from a length of low-cost pliable, resilient substantially-cylindrical hose, simply by trimming and removing material from sections 20 and 30. Once formed, closure 100 has: a first "base" section 10 of unmodified hose with a substantially O-shaped cross-section; a second "neck" section 20 of greatly-trimmed hose with a substantially parenthesis-shaped cross-section; and a third "clamp" section 30 of minimally-trimmed hose with a substantially C-shaped cross section.

Clamp section 30 may be formed by removing a narrow linear strip of hose material along a line drawn substantially parallel with the cylindrical axis of the hose, leaving the remaining hose material of section 30 with a substantially C-shaped cross section, the width of the removed strip is typically substantially less than half of the circumference of hose section 30. Preferably, the removed strip is narrow enough so that inner circumference of the C-shaped cross section is still greater than half of the exterior cross section of section 10; of course, this will depend on the wall thickness of the hose material used. Advantageously, the cut or formed edges of the "C" are smoothed or rounded so as not to have any rough or sharp edges or corners.

Hinge 20 is formed similarly to clamp 30, except that the removed strip is a larger part of the hose material. In general, more than half of the hose material will be removed in neck 20, leaving a narrow strip of material with a parenthesis-shaped cross section joining sections 10 and 30.

Between base section 10 and neck section 20, there is a transition region or "base shoulder" 15 where the partial circumference of remaining hose material changes rather dramatically. Similarly, between clamp section 30 and narrowed neck section 20 there is a another transition region or "clamp shoulder" 25 where again the partial circumference of remaining hose material changes. The transitions in these regions may be abrupt as drawn for shoulder 15 in FIG. 1, or they may be gradual as drawn for shoulder 25 in FIG. 1. Finally, there is a cut end or opposing "shoulder" 35 at the far end of clamp 30 which is the end of the closure. It is advantageous if all corners are rounded in these transition regions, so that stresses are not concentrated in the corner regions, leading to premature cracks and failures.

Figure 2:
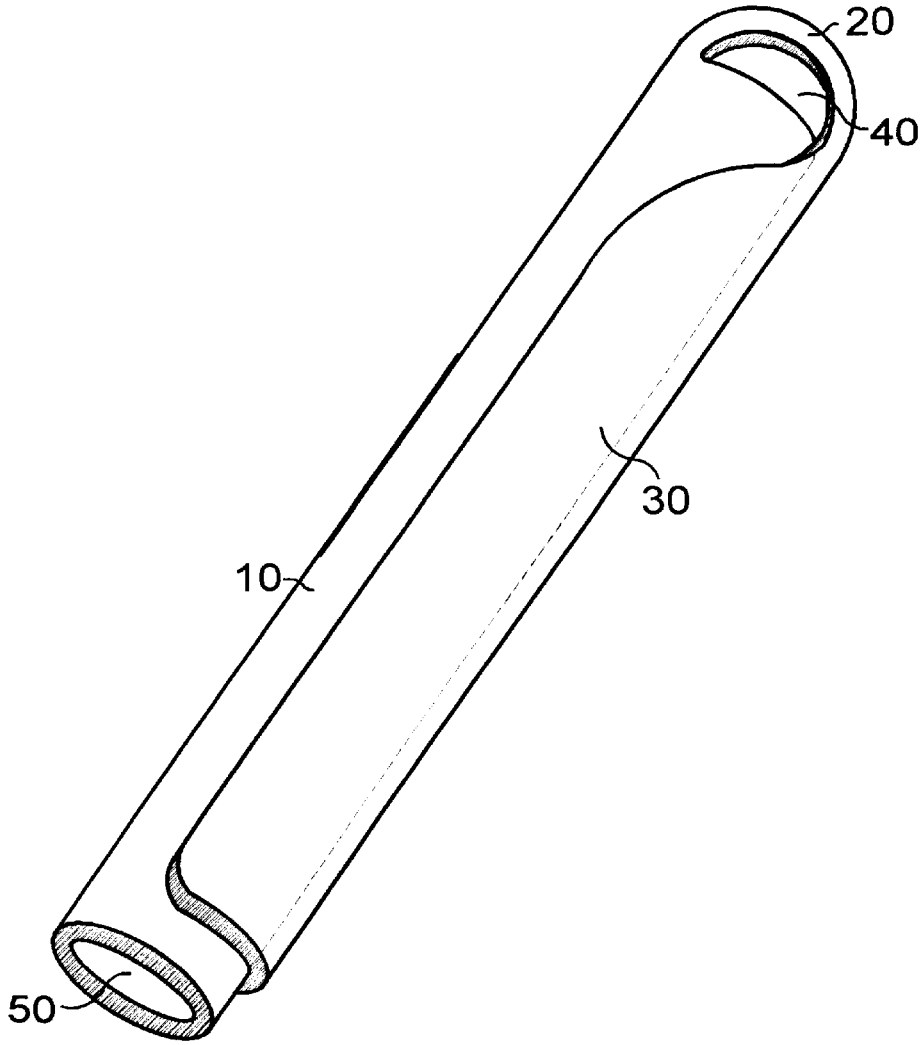
FIG. 2 is a diagram showing the bag closure of the present invention in its folded state, as when it is clamped over a bag.

Operation-FIGS. 1,2—Bag Closure 100

Bag closure 100 is used by smoothing and flattening a bag neck across cylindrical base 10, folding the closure at its narrowed neck or hinge 20 and forcing clamp section 30 over the cylindrical base 10, trapping the bag neck between base 10 and clamp 30 and forming a tight seal. FIG. 2 shows closure 100 in this closed position, with clamp section 30 surrounding base 10.

As previously mentioned, the transition regions 15,25 may be abrupt as drawn for shoulder 15 in FIG. 1, or they may be gradual as drawn for shoulder 25 in FIG. 1. Generally, and especially if the clamping action of the bag closure is particularly tight, a gradual shoulder 25 is advantageous, as it is easier to get the clamp "started" over base 10 with a gradual shoulder 25.

Bag closure 100 depends on the geometrical properties of the design as well as material properties of the hose material for its functionality. A hollow tubular shape is one of the most rigid material forms, regardless of the material forming the tube; this is due entirely to the geometry of the situation. Structural members of tubular shape are similar in stiffness to I-beams of similar dimensions, for example. When a tubular structure is bent, the wall material must be stretched on the outside of the bend while simultaneously being compressed on the inside of the bend, or else the entire tubular shape must be deformed in the area of the bend. When a pliable hose is bent more than a few degrees, the primary mechanism is that the hose deforms or flattens in the region of the bend.

If the hose is slit along its length, the geometrical properties of the hose are changed, making it easier to deform and thus easier to bend. This happens because the slit can widen as needed when the hose is bent, since it is no longer joined along this line. Of course, when a thin strip is removed along the hose's length, a quite similar situation is obtained; so C-shaped section 30 is easier to bend than semi-rigid base section 10.

If even more material is removed, the geometrical situation changes even more drastically. Once more than half the circumference of the hose material is removed, the remaining material can quickly deform into a nearly flat condition when bent perpendicular to the central surface of the remaining material. So section 20 with its parenthesis-shaped cross section will closely resemble a similar completely-flat strip of the material in required bending force, and will be much easier to bend even than C-shaped section 30.

Thus, the structure shown in FIGS. 1,2 is divided into three sections with drastically-different resistance to bending. Interestingly, this qualitative comparison is true regardless of what hose material is used. By comparison, base section 10 is nearly rigid, while clamp section 30 is somewhat easier to bend and neck section 20 is by far the easiest to bend. In any case, the result is that a length of hose modified as shown in FIGS. 1,2 will bend primarily at the neck or hinge 20, regardless of the hose material used.

Yet the hose material used for bag closure 100 is still important. A pliable material is desired so that hinge 20 can be bent or straightened many times without experiencing fatigue failure. However, low cost "rubbery" materials with this property are widely available. Yet it is important that the material used should also be resilient so that clamp section 30 will tend to keep its shape over time. A too-soft material or a material which tends to flatten out once the hose is slit will not be suitable, since the bag closure will not trap the bag securely when closed, or may not remain in the closed position as shown in FIG. 2 once clamped over a bag neck.

However, low cost materials with both required properties do exist, such as various rubbers and composites or other familiar hose materials. For example, some commonly-available garden hoses have suitable material properties for use in the bag clamp of the present invention.

Although the relative geometries of the various sections 10,20,30 have remained substantially undefined up till now, one of average skill in the art can see how these must be related to the properties of the hose material in order for bag closure 100 to function properly. For example, section 20 needs to be longer than the outer diameter of the hose so that section 10 can be clamped within section 30 without distortion near loop 40. And the hose from which closure 100 is manufactured must have a great enough wall thickness so that section 30 has a resilient "clamping" action, and so that unmodified hose section 10 will be somewhat rigid, yet the hose material must allow itself to be easily bent when narrowed as in section 20.

The actual wall thickness required is of course dependent on the type of material actually forming the hose and its stiffness. For example, although it is generally intended that the bag closures of the present invention be manufactured from common low-cost resilient hose materials, a bag closure 100 might be also be manufactured from other materials, providing that the material properties and geometries were appropriate. For example, a closure made of steel sounds unfeasible if one envisions a rigid steel pipe with thick walls, but a bag closure made of pliable and resilient very-thin spring steel with an especially-narrow neck 20 might be physically and even economically acceptable.

Description-FIG. 2—Orderly Storage Using the Bag Closure

Furthermore, the geometric properties of the present design synergistically provide several features useful for orderly storage of bagged materials when using bag closure 100 of the present invention. Referring to FIG. 2, the reader will see that the neck 20 automatically forms itself into a loop 40 when bag closure 100 is closed. This loop is handy for storing a closure 100 by hanging it from a hook or nail in the wall, if closure 100 is stored in the closed state. And when closure 100 is clamped over the neck of a bag, then the bag, contents and closure might all be hung by this same loop from a hook or nail. Even an array of such bag/closures might be hung from an array of hooks, for organization.

Again referring to FIG. 2, it may also be seen that when bag closure 100 is folded, it forms a fairly-stiff hollow cylinder with one open end formed by hole 50 of the original hollow hose. A folded bag closure 100, with or without a depending bag, can thus be hung from a substantially-horizontal "finger" which can fit within hole 50, of length comparable to base 30. This finger can be any elongated member of strength great enough to hold the bag and closure, such as a large nail or perhaps a wooden dowel protruding from the wall. Then closure 100 and its dependent bag can be hung by placing closure 100 over the dowel with the dowel inserted into hole 50. With an array of such dowels protrudingly mounted on a board, a plurality of bag/closure combinations could be hung with the bags overlapping in close proximity to each other, yet presenting an overall neat and orderly appearance. Or an array of such dowels mounted such that they can fold horizontally to either side might be used for a yet more convenient organized storage of the bagged materials.

Even arrangements of such dowels arrayed in radial symmetry (as the spokes of a wheel) might be constructed, perhaps on a hub so as to form a sort of "lazy-susan" of bagged storage.

Description-FIGS. 1,3*a,b,c*—Topological Variations of Cylindrical Hose

Automated manufacturing of hoses is a relatively mature technology dealing with an extremely simple, essentially two-dimensional article of manufacture. Although the materials forming the hoses may themselves be quite complicated and unique, hoses of great length can be manufactured easily and for low cost once the "recipe" is known and the machinery has been set up. And cylindrical hose has only two major critical dimensions: the wall thickness and the radius of the hose. Such hoses are available in bulk quantities at a low cost with an almost endless variety of physical and mechanical properties.

However, if variations from the basic cylindrical shape are considered, there are additional design considerations that can be made. Unsurprisingly, non-uniformity and uncontrolled changes in the two-dimensional cross section of the hose used as the raw material of the bag closures can have significant effects on the function of the resulting closures Conversely, a controlled change in hose cross section can be used to purposely alter and improve the closures without changing the physical properties of the hose material. And of course, since this particular type of change basically amounts to a change in a single die on a hose-manufacturing machine, changing the hose cross section is a relatively minor alteration in the hose manufacturing procedure and should not add significantly to the hose cost. In many instances, it may be much simpler to change the cross section of the hose to compensate for the material properties of a well-tested and low cost hose material than to change the recipe for the hose material. Essentially, the ability to designate the desired hose cross section adds another design criteria by again changing the geometry of the overall situation. Even minor changes to the cross section can materially improve the function of the resultant bag closures. Less than optimal material properties can be offset by compensating changes in the geometry of the hose cross section.

For example, one potential way to improve the sealing action of a bag closure of the present invention would be to add ridges, preferably to both the inside and outside of the hose. Of course, the placement and sizes of the ridges would have to be considered to obtain the best effect.

FIG. 3*a* shows an example cross section of a folded bag closure 100 of the present invention, wherein the bag closure has been formed from such ridged hose; the cross section is taken through sections 10 and 30 of the clamped bag closure. If it is desired to match the spacing of ridges between the inside of clamp 30 and the outside of base 10, then the ridges should be equally spaced on the bulk hose stock, and there should be more ridges on the outside than the inside of the hose. For example, the hose used as raw material in FIG. 3*a* has 7 equally spaced inside ridges 60 and 10 equally spaced outside ridges 70; after section 30 is formed by removing a thin strip of material, there are still (barely) 7 inside ridges 60, but only 8 outside ridges 70 remain. The ridges are placed so that they are equally spaced in circumferential distance along the inside of clamp 30 and the outside of base 10, when clamp 30 is forced over base 10. As can be seen from FIG. 3*a*, the outer hose ridges 70 of base 10 thus interleave in a meshed interlocking manner with inner ridges 60 of clamp 30 when clamp 30 is forced over base 10. This forces a bag neck 80 to take a meandering path around base 10, with multiple tightly-clamped regions; an especially tight seal would be expected from this modification.

Figure 3B:
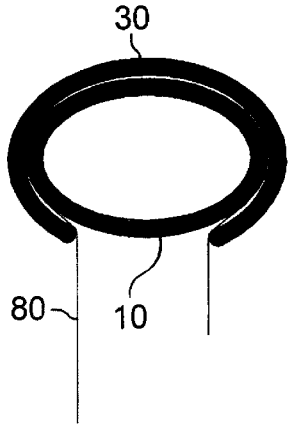

Another alternate hose cross section is shown in FIG. 3*b*. In this case, the hose used as raw material has an elliptical cross section, where the closure bends parallel to the axis of the ellipse. This variation might be used where the hose material is not as resilient as might be desired, so that a hose of circular cross section does not clamp securely. If, however, a hose of the same material but with an elliptical cross section is used as shown in FIG. 3*b*, the clamping action will be more secure.

Figure 3C:
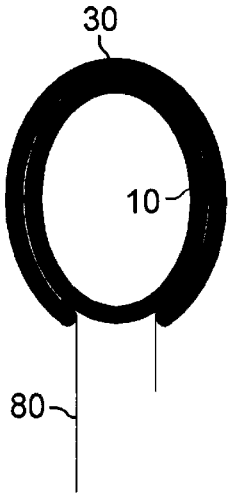

And of course, if the elliptical hose is turned ninety degrees, as shown in FIG. 3*c*, the clamping action will be diminished below what would be seem for a hose of circular cross section. The design shown in FIG. 3*c* would therefore be appropriate if a material were used where the cylindrical hose clamped too tightly.

Description-FIGS. 1,4—Efficient, Low Cost Manufacturing of the Bag Closures As has been previously described, the bag closures of the present invention may advantageously be constructed by trimming and otherwise modifying lengths of separately-manufactured bulk hose stock. Basing the bag closure of the present invention on pre-manufactured hoses in this manner effectively isolates all of the complicated material-related manufacturing problems at the hose factory, leaving only the final forming of the closure itself as the entire process to be performed by the closure manufacturer. If the bulk hose stock meets the agreed-upon specs, the closures should perform as designed. The closure factory might consist of only a few essentially identical machines which accept the bulk hose as their raw material, and which then cut the hose into the desired patterns, perhaps with roller knives, turning out the desired closures in quantity. No messy plastics feedstocks or high temperature processes are required. And closure 100 is truly of one-piece construction in that it is cut from the hose stock in a single piece. There are no small pieces to mold, track, and later assemble. The bag closure of the present invention can be made via a truly simple manufacturing process.

As described in the discussions of FIG. 1, each bag closure 100 may be formed by trimming and removing strips of appropriate widths from a length of hose to form sections 20 and 30 of the closure. Although it has not been explicitly discussed, the strips of materials removed from the hose in forming sections 20 and 30 would typically be seen as waste and discarded. However, if certain geometrical rules are followed, this waste can be essentially eliminated. Specifically, if sections 20 and 30 are made of approximately the same length, and sections 20 and 30 and their respective shoulders are made complementary to each other, then bag closures can be manufactured in a way that minimizes the wastage of hose material.

FIG. 4 shows how two substantially identical bag closures 100 and 200 may be obtained from a single piece of hose only about 4/3 as long as that required to make a single closure, if these geometrical restrictions apply. In FIG. 4, sections 20 and 30 of each closure are complements of each other in the sense that the parenthesis-shaped cross section found in section 20 could be added to the C-shaped cross section of section 30 to form the original O-shaped cross-section of unmodified hose. Thus, the neck section of closure 100 can be made at the same time and from the same length of hose as the clamp section of closure 200, and vice versa. For example, the strip "removed" from the clamp section of closure 100 forms the narrow neck of closure 200. Also, the shoulders 25 of the two closures 100,200 are complementary; and each shoulder 15 is advantageously complementary with each cut end or opposite shoulder 35 of clamp 30. With these assumptions, the lengths of sections 10,20,30 are all approximately equal, so that an entire closure is about 3 times as long as one of the sections. Yet the two closures 100 and 200 are formed from a section of hose of with a total length equal to only about 4 sections. So by imposing these restrictions, the hose material trimmed in forming bag closure 100, which might normally be lost or discarded, is instead incorporated into closure 200; and the otherwise wasted material of closure 200 is used in closure 100. This approach leads to a saving in materials of as much as 50%.

Referring again to FIG. 4, it can be seen that when two identical interleaved bag closures are cut from a single length of hose, both ends of the hose length become the ends of the respective unmodified hose sections 10. Thus, this procedure can be repeated indefinitely, forming pairs of identical closures from successive lengths of hose cut from bulk rolls of hose stock. By changing the size of the lengths of hose and still adhering to the above-mentioned geometrical rules, bag closures suitable for different sized bags of various widths can be formed as desired, all without significant wastage of materials. Such a process can be easily automated with simple, reliable and low cost machinery, the design of which is nevertheless beyond the scope of the present invention.

Description-FIG. 5—Other Geometrical Variations of the Bag Closures

Of course, geometrical variations other than changes in the cross-section of the hose base stock can be made when manufacturing the bag closures of the current invention. One such is shown in FIG. 5, wherein clamp section 30 is formed with a non-uniform cross section. In FIG. 5, the transverse cross-section is still substantially C-shaped throughout section 30, but the degree of arc spanned by the "C" varies from point to point along the length of section 30. In FIG. 5, this is done such that a plurality of "fingers" 33 are formed, wherein the cross-section spans a greater degree of arc, separated by regions wherein the cross-section spans a lesser degree of arc. In the region of a finger 33, the clamping action is particularly strong, and in the interstices between said fingers, the clamping action is substantially lessened; this gives rise to a clamp which has an overall strong clamping action, but which is easier to remove or put on that a clamp with a uniform cross-section in section 30.

Conclusion, Ramifications, and Scope

Accordingly, the reader will see that the present invention provides a durable, low cost bag closure capable of producing a tight seal by trapping a flattened bag neck between a substantially tubular section of hose and a clamping section of trimmed hose with a substantially C-shaped cross-section. By fabricating the bag closure from readily-available flexible and resilient hose material, a simple one-piece closure is provided wherein the tube and clamp sections are joined by a strip of durable, flexible material which acts as a hinge yet which cannot be easily broken like a rigid hinge.

And the present invention can be manufactured more easily and quickly than prior art hinged bag closures. By using low cost and widely available bulk hose material as the raw material of the closure manufacturing process, the closure of the present invention essentially banishes any material problems and high-temperature or chemical processing to the wholesale supplier's hose manufacturing facility. The only processing required of the closure manufacturer is the ability to trim and cut the hose material. And the true one-piece design of the present invention requires no assembly, unlike prior-art rigid hinged bag closures which must be assembled from several smaller components.

Because of this fast and simple production method, relying on low cost widely available raw materials and further requiring no assembly, little equipment and few employees, the closure of the present invention can be manufactured at a lower cost than prior art hinged bag closures.

The provided bag closure is easily cleaned and can be reused indefinitely; and it presents a neat and tidy appearance in use. Even more usefully, the geometric properties of the ergonomic and simple design synergistically provide features which make the present bag closure particularly well suited for organizing bagged materials. A loop automatically formed when the closure is folded, and the hole inherently present in the unmodified hose end, both provide means for hanging the bag closure and a dependent bag from hooks, pegs or dowels in various orderly arrangements.

Although the above specifications contain many specificities, other variations of the present invention will be readily apparent to one of average skill in the art, applying the concepts and ideas contained herein to other applications than those set forth. For example, topological variations in the essentially cylindrical hose such as appropriately ridged hoses or hoses of elliptical or other cross sections might well be used to manufacture closures of the present invention. Thus, the scope of the invention should be determined by the appended claims and their legal equivalents, rather than by the examples given.

We claim:

1. A bag closure, of the type generally comprising two separate but generally complementary elongated members which trap the flattened neck of a bag between them when mated, comprising:

a first, comparatively stiff substantially-tubular elongated base section with a free end and a hinge end, having a substantially uniform essentially O-shaped cross-section;

a third substantially-resilient elongated clamp section with a free end and a hinge end, having a cross-section which is substantially C-shaped throughout its length;

wherein the exterior of said O-shaped cross-section and the interior of said C-shaped cross-section are substantially complementary in shape, but are not complementary in size;

such that the outer diameter of said base section generally exceeds the inner diameter of said clamp section;

wherein said substantially-resilient clamp section nevertheless allows said base section to be forced into said clamp section;

such that said clamp section experiences substantial deformation whenever said base and clamp sections are mated; and a second hinge section, connecting said base hinge end to said clamp hinge end, said hinge section providing folding means whereby said clamp section can rotate around said hinge section toward said base section, like the blade of a jack-knife;

such that when said bag closure is used to close said bag, the flattened neck of said bag is laid over said base section, said clamp section is rotated toward said base section, and said clamp section is forced over said bag neck and said base section;

whereby said bag neck is trapped between said base section and said clamp section, said deformation of said clamp section providing an especially tight seal of said bag.

2. The bag clamp of claim 1 wherein the angle subtended by said C-shaped cross-section when said base section is matingly inserted within said clamp section, whereby said clamp partially surrounds said base, exceeds 180 degrees of arc somewhere along the length of said clamp;

whereby said resilient clamp retains said base.

3. The bag clamp of claim 2 wherein the angle subtended by said C-shaped cross-section when said clamp and base are mated, whereby said clamp partially surrounds said base, uniformly exceeds 180 degrees of arc along the length of said clamp;

whereby said resilient clamp retains said base uniformly along the length of said clamp.

4. The bag clamp of claim 1 wherein said first base section comprises a substantially-tubular first length of substantially-unmodified first hose.

5. The bag clamp of claim 4 wherein said clamp section comprises a third length of substantially-resilient third hose, which hose is modified such that it has said substantially C-shaped cross-section.

6. The bag clamp of claim 5 wherein said clamp section is formed from said third length of hose by removing hose material extraneous to said C-shaped cross-section.

7. The bag clamp of claim 4 wherein said hinge section comprises a substantially-pliable modified second length of second hose.

8. The bag clamp of claim 7 wherein said modified second length of hose is modified such that it is substantially more flexible than unmodified second hose.

9. The bag clamp of claim 8 wherein said modified hose has a substantially parentheses-shaped cross-section.

10. The bag clamp of claim 9 wherein said hinge section is formed from said second length of hose by the removal of hose material extraneous to said desired parenthesis-shaped cross-section.

11. The bag clamp of claim 10 wherein said clamp section comprises a third length of substantially-resilient third hose, which hose is modified such that it has said substantially C-shaped cross-section.

12. The bag clamp of claim 11 wherein said clamp section is formed from said third length of hose by the removal of hose material extraneous to said desired C-shaped cross-section.

13. The bag clamp of claim 12 wherein said C-shaped cross-section of said clamp is substantially non-uniform;

wherein the angle subtended by said cross-section may vary periodically along the length of said clamp, from below 180 degrees to substantially greater than 180 degrees of arc, thereby forming a plurality of fingers in said clamp region which hold said base when said base and clamp are mated;

whereby when said bag clamp is used, said base is more easily inserted into said clamp, yet said clamp holds said base and bag neck firmly when so inserted.

14. The bag clamp of claim 12 wherein, prior to said removal of hose material to form said hinge and clamp sections, a single overall length of substantially uniform substantially-resilient, substantially-pliable hose comprises said first, second and third lengths of hose;

such that said first, second and third lengths of hose comprise first, second and third contiguous sub-lengths, respectively, of said overall length of hose;

whereby said bag clamp is formed from said overall length of hose simply by selectively removing hose material from said contiguous second and third sub-lengths of said hose.

15. The bag clamp of claim 14 wherein said hose has a first plurality of exterior ridges on its exterior surface and a second plurality of interior ridges on its interior surface;

wherein said ridges run uniformly lengthwise along the length of said hose;

wherein said interior ridges and exterior ridges are spaced so as to matingly mesh with one another when said base section is mated within said clamp section;

whereby said flattened bag neck, thereby trapped between said clamp and said base, is forced to take a meandering path around said base;

whereby said bag neck is held and sealed more tightly.

16. A first bag clamp of claim 14, further comprising a second bag clamp of claim 14;

wherein each clamp section of said bag clamps is approximately equal in length to the hinge section of the other;

wherein said first and second bag clamps are complementary, such that each said clamp section comprises the hose material that must be removed from the hinge section of the other, and each said hinge section comprises the hose material that must be removed from the clamp section of the other;

whereby said second and third sub-lengths of hose of said first bag clamp comprise said third and second sub-lengths of hose of said second bag clamp, respectively;

whereby, by cutting said hose along the lines delineating said removals of hose material, said first and second bag clamps are formed from a single all-inclusive length of substantially-resilient, substantially-pliable hose comprising first, second, third and fourth contiguous sublengths;

wherein said contiguous first, second and third sublengths of said all-inclusive length of hose form said first, second and third lengths of hose of said first bag clamp, respectively; and wherein said contiguous second, third and fourth sub-lengths of said all-inclusive length of hose form said third, second and first lengths of hose of said second bag clamp, respectively.

17. A method for forming a bag closure from a single length of pliable, resilient substantially-tubular first hose, said hose having a substantially uniform essentially O-shaped cross-section, wherein said bag closure is of the type generally comprising two separate but generally complementary elongated members which trap the flattened neck of a bag between them when mated, comprising:

a) delineating said length of hose into three contiguous sublengths of hose, wherein the first and third sub-lengths will form the generally complementary elongated members of said bag closure, and the second sublength will form their connecting hinge;

b) trimming away hose material in said second sublength, leaving a substantially parenthesis-shaped flexible strip of remaining hose material connecting said first and third sublengths;

c) trimming away hose material from said third sublength along its entire length, leaving said third sublength with a substantially C-shaped cross-section;

whereby, when said bag closure is used to close said bag, the flattened neck of said bag is laid across said first sublength, said second sublength is flexed, thereby bringing said third sublength adjacent to said first sublength, and said third sublength is forced over said bag neck and said first sublength, thereby trapping said bag neck and sealing said bag;

wherein the interior diameter of said third sublength, being formed from the same hose as said first sublength, is less than the exterior diameter of said first sublength;

wherein said third sublength, being formed from said resilient hose, nevertheless allows said first sublength to be forced inside said third sublength;

such that said third sublength experiences substantial deformation whenever said first sublength is forced within said third sublength;

whereby said bag closure holds said bag neck especially tightly, and forms an especially tight seal of said bag.

* * * * *